United States Patent [19]

Magistretti

[11] Patent Number: 4,628,552

[45] Date of Patent: Dec. 16, 1986

[54] ADJUSTABLE BACK AND ARM STRUCTURE FOR BED HEADS, SOFAS AND THE LIKE

[75] Inventor: Vico Magistretti, Milan, Italy

[73] Assignee: Flou S.p.A., Milan, Italy

[21] Appl. No.: 665,626

[22] Filed: Oct. 29, 1984

[30] Foreign Application Priority Data

Nov. 15, 1983 [IT] Italy ..... 23725 A/83

[51] Int. Cl.[4] ..... A47C 17/00; A47C 20/04

[52] U.S. Cl. ..... 5/52; 5/53 D; 5/72; 5/74 R; 5/75; 5/433; 297/417

[58] Field of Search ..... 5/72, 74 R, 74 B, 75, 5/77, 52, 53 R, 53 B, 53 D, 432, 433; 297/355, 417

[56] References Cited

U.S. PATENT DOCUMENTS 2,492,430 12/1949 Koch ..... 5/72
2,554,799 5/1951 Sprunger ..... 5/433
3,178,733 4/1965 Wachsman ..... 5/433
3,482,271 12/1969 Enright ..... 5/432
3,683,430 8/1972 Bradley ..... 5/433
3,774,247 11/1973 Bradley ..... 5/433
3,790,973 2/1974 Bradley ..... 5/433

FOREIGN PATENT DOCUMENTS 738597 10/1955 United Kingdom ..... 5/72

*Primary Examiner*—Gary L. Smith
*Assistant Examiner*—Michael F. Trettel
*Attorney, Agent, or Firm*—Karl F. Ross; Herbert Dubno

[57] ABSTRACT

An adjustable back and arm structure for beds, sofas and the like where it is possible to have a vertical arrangement, adapted for the use as a bed, of elements which can be lowered and inclined to form backrests and armrests or shelves. This structure can be realized so as to obtain lowering with a single movement or by independently actuating elements having backrest and armrest or shelf functions.

5 Claims, 11 Drawing Figures

ADJUSTABLE BACK AND ARM STRUCTURE FOR BED HEADS, SOFAS AND THE LIKE

FIELD OF THE INVENTION

The present invention relates to a back support for more comfort while staying in bed, for reading or the like, in a sitting position.

BACKGROUND OF THE INVENTION

Generally, pillows are employed, but it is not possible in that way to have a sufficiently stable supporting form.

It may furthermore be desired to have lateral arms or shelves the presence of which, as well as the presence of supporting elements for the human back, must be removable in order to use the bed for sleeping.

The use of sofa-beds, besides, requires that in the sofa position a longitudinal back be provided at a distance from the front edge of the sofa-bed which is substantially narrower than the width required for a comfortable bed.

OBJECT OF THE INVENTION

It is therefore an object of the invention to provide a back for sofa-beds which settles in an advanced and inclined position, possibly having one or more arms or shelves at its sides, and which can be drawn up for the use together with arms.

SUMMARY OF THE INVENTION

This result is achieved, according to the present invention, by an adjustable back structure for bed heads, sofas, easy-chairs and the like, consisting of one or more elements having backrest functions and one or more elements having armrest or shelf functions, the elements being provided with supporting means for allowing the elements themselves to be arranged side by side in the same plane in a substantially vertical position and to be lowered and inclined in different positions. In particular,. the element or elements having backrest functions can be arranged in a slanting position and the element or elements having arm or shelf functions can be arranged in a substantially horizontal position.

According to an embodiment of the present invention the means supporting each of the elements having arm or shelf functions consist of a pair of connecting rods hinged at one end in two points of a fixed supporting structure and at the opposite end in two points of a plate supporting the element, the reciprocal distances between the points of the supporting structure and between the points of the plate being such as to cause the horizontal positioning of the element in the lowered position and the substantially vertical positioning in the raised position, locking means or the like being provided for blocking the element in one or the other position.

According to said embodiment the said means supporting each of the elements having backrest functions consist of one or more plates bearing one of the elements, each of which is hinged on a fixed supporting upright, and of one or more levers bearing at the end at least one wheel or roller or the like, which lever or levers can be integral to a driving shaft pivotally constrained to one end of one of the connecting rods of the means supporting the elements having armrest or shelf functions, the wheel or roller acting against the rear surface of the back element so as to arrange it obliquely, in an inclined position, in contrast with elastic means or the like on rotation of the driving shaft.

According to a different embodiment each of the means supporting each of the elements having armrest or shelf functions or backrest functions comprises an arm hinged at one end on a fixed supporting structure and, at the opposite end, on a plate supporting the element, while an inextensible cable or the like acting in contrast with elastic means could be provided, causing a rotation of the element with respect to the arm on rotation of the arm with respect to the fixed structure, thus bringing the element in a lowered position with a horizontal or oblique positioning, while locking means could be furthermore, or in alternative, provided for locking the element in the vertical or horizontal position.

The arm of each of the means supporting the element or elements having backrest functions can be pivotally connected to the armrest bearing the element having arm functions by means of a shaft or the like transmitting a rotation smaller than the rotation of the arm of the element having armrest functions.

In the structure according to the described embodiments the locking in the vertical position and in the horizontal or inclined position can be obtained by elastic means or the like of the bistable type in the two end positions.

Furthermore, in the structure according to the invention, the movement of the armrest element can be connected to the movement of the backrest element or, more simply, the movements of the elements having armrest or backrest functions can be independent.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
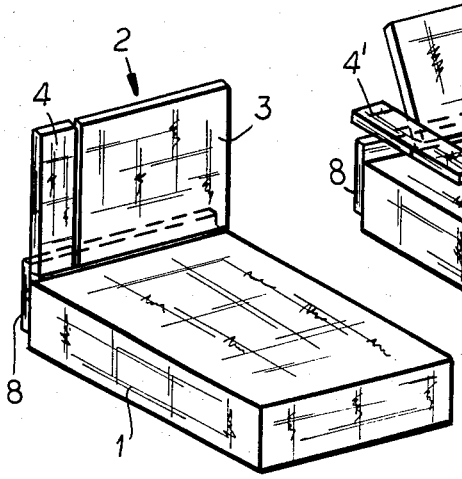
FIG. 1 is a diagrammatic perspective view of a bed provided with the device for joining the head to the bed according to the invention, with the head raised.
Figure 2:
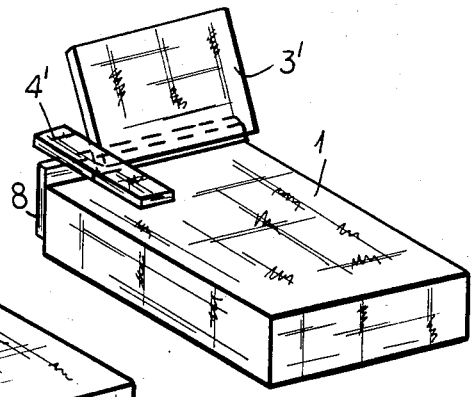
FIG. 2 is a diagrammatic perspective view of the bed of FIG. 1 with the arm lowered and the back inclined.

As FIGS. 1 and 2 show, there is a bed 1 provided with a headboard 2. The headboard is divided into parts, for example a greater size portion 3 and a smaller width portion 4. In FIG. 2 there is shown the portion 3 inclined for constituting a backrest in the position 3' and the portion 4 lowered and advanced for constituting an armrest in the position 4'.

Figure 3:
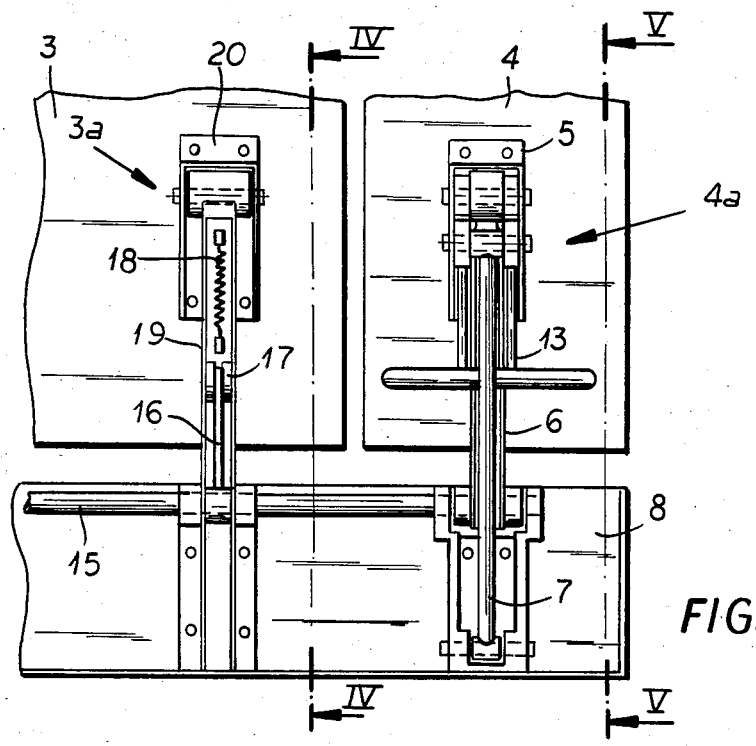
FIG. 3 is an embodiment of the joint device according to the invention in a front elevational view.

In FIG. 3 there is illustrated an embodiment of the structure for supporting the headboard 2, in which there is shown the member 4a supporting the armrest 4 as well as one of the members 3a supporting the backrest 3, generally present in pairs. In this embodiment the supporting members are provided so as to allow the lowering movement exerted on the armrest 4 to bring it in the position 4' and the movement of the backrest 3 inclining it in the position 3'.

Figure 4:
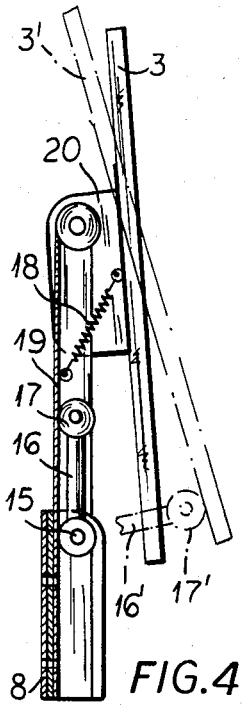
FIG. 4 is a section taken along the line IV—IV of FIG. 3.
Figure 5:
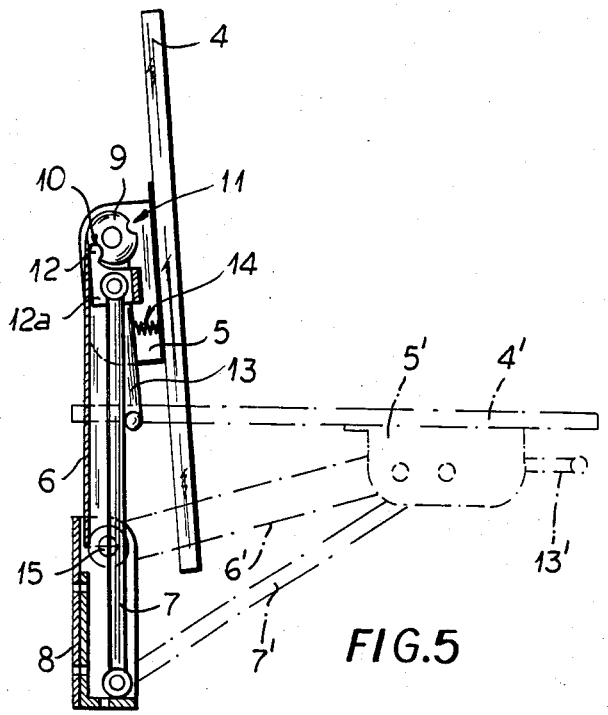
FIG. 5 is a section taken along the line V—V of FIG. 3.

In FIGS. 4 and 5 there is shown a lateral view of the mechanism realizing the coupling.

The armrest 4 is supported by a plate 5 to which a pair of connecting rods 6 and 7 are respectively articulated.

At the opposite end the connecting rods 6 and 7 are hinged on the fixed member 8 supporting the headboard of the bed 1.

In a position coaxial with the hinge joining the connecting rod 6 to the plate 5 there is a ring 9 provided with hollows 10, 11, into which a tooth 12 of a rotating locking member 12a can be inserted, which is actuated by a lever 13 connected with a spring 14. When the armrest 4 is in the raised position, the tooth 12 is inserted into the hollow 10.

In FIG. 5 the armrest in the lowered position is shown with the reference 4'; to such a position there corresponds the insertion of the tooth 12 into the hollow 11. The connecting rod 6, at its hinging position on the fixed supporting member 8, is pivotally integral with a driving shaft 15 which bears, in correspondence to each of the members 3a supporting the backrest 3, an arm 16 bearing one or more wheels or rollers 17. A spring 18 or the like keeps the backrest 3 normally in the upright position, which is supported by the fixed arm 19 by means of the plate 20 to which it is pivoted. When the arm 4 is lowered, the swinging of the connecting rod 6 causes the rotation of the driving shaft 15, which rotates the arms 16 into the position 16' of FIG. 4, thus causing the inclination 3' of the backrest 3.

Figure 6:
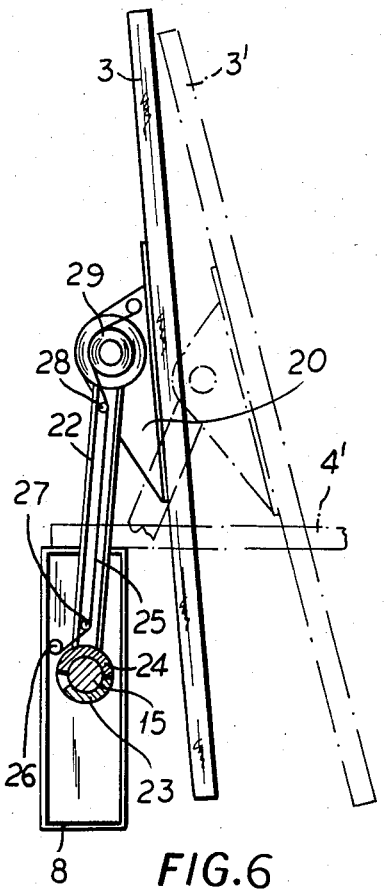
FIG. 6 is a view corresponding to the view of FIG. 4 according to another embodiment of the invention.
Figure 7:
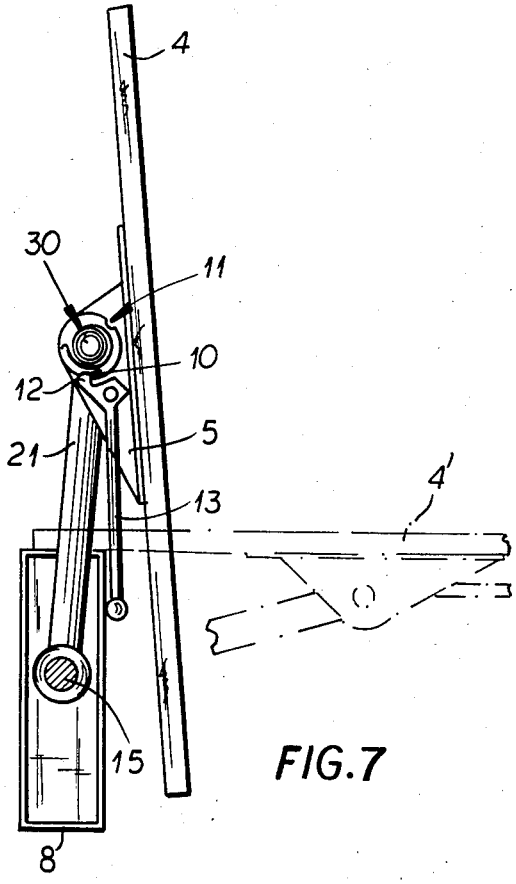
FIG. 7 is a view corresponding to the view of FIG. 5 of the other embodiment.

FIGS. 6 and 7 illustrate a different embodiment in which the arm 4 is supported by only one armrest 21 which is connected at one end to the shaft 15, which controls the movement of the arm 22 supporting the backrest 3.

The rotational connection between the arm 21 and the shaft 15 can be advantageously realized, as FIG. 6 schematically shows, by means of a sector 23 integral with the shaft 15 and a sector 24 integral with the arm 22. As the figure shows, the two sectors are separated each from the other by a free space corresponding, for example, to a 45° angle, so that the complete rotation of the arm 21 bearing the armrest 4 into the position 4' causes a limited rotation of the arm 22 bearing the backrest 3 into the position 3'.

The rotation of the armrest 4 and thus backrest 3 in a direction opposite that one of the corresponding supporting arms 17 is caused in this case by a connection of the inextensible cable 25 shown in FIG. 6. In the connection, the cable 25 is fixed at one end to the fixed supporting member 8 by means of the pin 26 and at the other end to the plate 5 supporting the armrest 4 (or to the plate 20 of the backrest 3).

The run of the cable 25 is determined by the pins 27, 28 and by the ring 29 and it is provided in such a way that the armrest 4, in the lowered position of the arm 21, is horizontal and the backrest 3 is inclined at the angle appropriate to the rotation of the arm 22.

In contrast with the action of said cable 25 there may be provided a spring 30, for example of the spiral type as shown in FIG. 7, which assures the repositioning of the arm or back in the upright position keeping in tension the cable 25.

In order to keep the arm in the lowered position, there may be provided a lock 13 with a tooth 12 and hollows 10, 11 as already illustrated.

Figure 8:
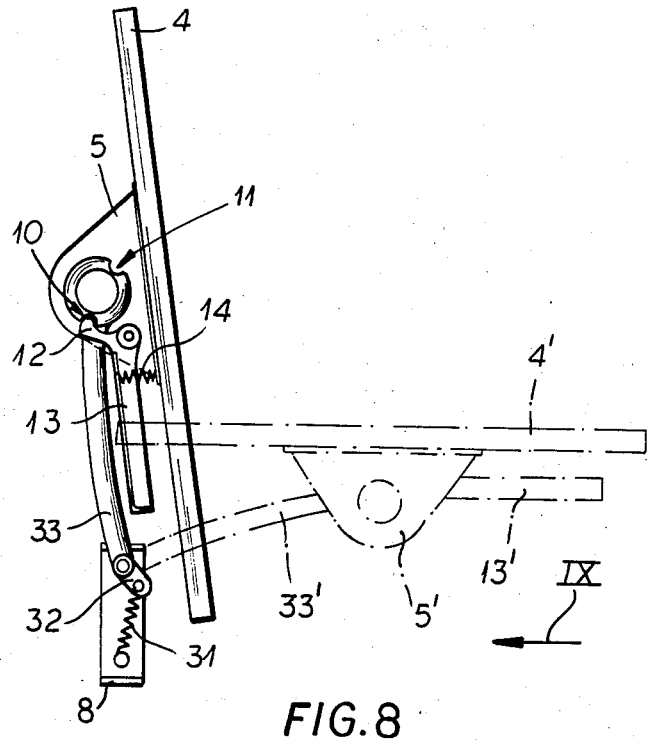
FIG. 8 is a view corresponding to FIG. 5 of still a further embodiment of the invention.

It is furthermore possible to use a lock employing a bistable arm, as shown in FIG. 8, in which there is provided an operating spring 31 connected to a lever 32 integral with armrest 23 bearing arm 4. The spring 31 can be applied, in the device of FIGS. 6, 7, to the arm 21 or both to the arms 21 and 22 when a greater stability in the extreme positions is desired.

Figure 9:
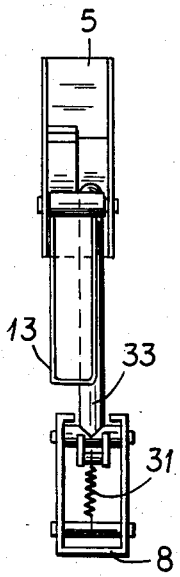
FIG. 9 is a view taken in the direction of arrow IX of FIG. 8.

FIGS. 8, 9 show a simplified device for supporting the armrest 4 in which the connection with the backrest 3 is not affected and the correct position of the arm, raised or lowered, is assured by the detent 12 which can be inserted into the hollows 10 or 11 as already described, and controlled by the lever 13.

Figure 10:
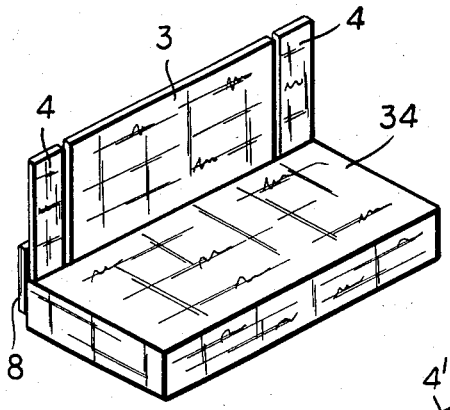
FIG. 10 is a perspective view of a sofa-bed according to the invention ready to be used a a bed.
Figure 11:
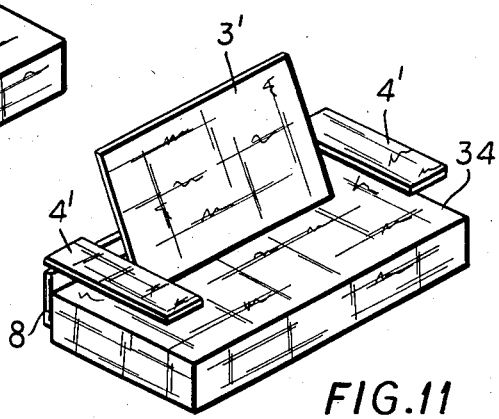
FIG. 11 is the sofa-bed of FIG. 10 ready to be used as a sofa.

The embodiment of FIGS. 6 and 7, or 8 and 9, is particularly suitable in the case in which there is no space available in the area lying behind the fixed supporting member 8. A particular application is shown in FIGS. 10 and 11 in which a sofa-bed 34 is shown, in arranged positions for the night and the day respectively.

In fact, it is necessary to have a bed of appropriate width and to have a more limited distance between the backrest 3 and the lateral edge of the sofa-bed 34 for the use as a sofa, as well as the possibility to avail oneself of the armrests 4.

The position of the backrest 3 in all the embodiments illustrated by way of example can be modified by employing a locking stop provided, in addition to the hollows 10 and 11, with further hollows into which the tooth 12 could be inserted.

As it appears evident to a person skilled in the art, many further embodiments can be provided within the scope of the present invention in addition to what is illustrated. It is furthermore possible to realize numerous constructive forms with one or more armrests, for single or double beds, with one or more independent backrests, or for sofas having different dimensions, with or without armrests, always remaining within the scope of the general characteristics of the present invention.

Backrests and armrests can be also realized in various materials, or provided with coverings and pads, according to the practical and aesthetical requirements of the desired use.

I claim:

1. An adjustable back and arm structure for beds, sofas, easychairs and the like, wherein said structure comprises at least one element having a backrest function and at least one other element having an armrest function, said elements each being provided with respective supporting means for enabling the elements to be arranged side by side in the same plane in a substantially vertical position of said elements and to be lowered and inclined into different positions, in particular said element having a backrest function being arrangeable in a slanting position and said element having an armrest function being arrangeable in a substantially horizontal position, wherein said means for supporting said element having an armrest function comprises a pair of connecting rods hinged at one end at two points of a fixed supporting structure and at the opposite end at two points of a plate supporting said armrest element, the reciprocal distances between said points of said supporting structure and said points of said plate being such as to cause the horizontal positioning of said armrest element in a lowered position thereof and the substantially vertical positioning in a raised position thereof, locking means being provided on said plate for locking said armrest element in at least one of the positions.

2. A structure according to claim 1 wherein said means for supporting said at least one element having a backrest function comprises at least one plate bearing said backrest element and hinged on a fixed upright support, and at least one lever bearing at an end thereof, at least one roller, said lever being integral at another end thereof with a driving shaft pivotally fixed to one end of one of said connecting rods of said means for supporting said element having an armrest function, said roller acting against a rear surface of said backrest element so as to arrange it obliquely, in an inclined position, in opposition with an elastic means acting between said backrest and said upright support on rotation of said driving shaft.

3. An adjustable back and arm structure for beds, sofas, easychairs and the like, wherein said structure comprises at least one element having a backrest function and at least one other element having an armrest function, said elements each being provided with respective supporting means for enabling the elements to be arranged side by side in the same plane in a substantially vertical position of said elements and to be lowered and inclined into different positions, in particular said element having a backrest function being arrangeable in a slanting position and said element having an armrest function being arrangeable in a substantially horizontal position, said respective supporting means each comprising at least one rod pivotally connected at one end thereof to a rear surface of a respective element, said rods being rotatably connectd at an opposite end thereof to a fixed part of the bed supporting structure, and means being provided at said pivotal connections for locking said element having an armrest function and its respective rod together in at least one of said positions, with further means being provided to cause upon rotation of a rod, a tilting in an opposite direction of the respective supported element, whereby a surface of a respective element defining a front face in the vertical position of the element becomes a supporting surface in the lowered position of the element.

4. A structure according to claim 3 wherein said means for tilting respective elements comprises an inextensible cable acting between said fixed supporting structure and the rear surface of the respective supported element.

5. A structure according to claim 4 wherein said rods of said means supporting said respective elements can be pivotally connected to one another by means of a shaft for transmitting a rotation by any one rod to another respective rod.

* * * * *